US006029381A

United States Patent [19]

Aleo et al.

[11] Patent Number: 6,029,381

[45] Date of Patent: Feb. 29, 2000

[54] AUTOMATED GRAPHICS SCROLLING ARRANGEMENT

[75] Inventors: Dino Diego Aleo; John Benjamin Radford, both of Windsor; Dino Luigi Villalta, Lasalle, all of Canada

[73] Assignee: Azurus, Inc., Windsor, Canada

[21] Appl. No.: 09/014,490

[22] Filed: Jan. 28, 1998

Related U.S. Application Data

[60] Provisional application No. 60/036,993, Jan. 30, 1997.

[51] Int. Cl.[7] ..... G09F 11/18

[52] U.S. Cl. ..... 40/471; 40/518; 40/467

[58] Field of Search ..... 40/471, 518, 467

[56] References Cited

U.S. PATENT DOCUMENTS

| | | |
|---|---|---|
| 3,726,031 | 4/1973 | Singer . |
| 3,829,997 | 8/1974 | Singer . |
| 4,525,946 | 7/1985 | Olson . |
| 5,072,534 | 12/1991 | Kodet . |
| 5,412,892 | 5/1995 | Filippakis . |
| 5,438,780 | 8/1995 | Winner . |
| 5,465,515 | 11/1995 | Walieddine . |
| 5,488,791 | 2/1996 | Boni . |
| 5,493,802 | 2/1996 | Simson . |
| 5,517,778 | 5/1996 | Simson . |

*Primary Examiner*—Cassandra H. Davis
*Attorney, Agent, or Firm*—Rohm & Monsanto, PLC

[57] ABSTRACT

A display arrangement presents sequential graphical data that corresponds to predetermined environmental features or points of interest, such as sequential holes of a golfcourse. The display arrangement is installed on the golf cart and the information that is sequentially displayed is correlated to the features of a golf course, such as the various physical characteristics of the respective golf holes. A user will actuate the arrangement by manipulation of an actuator switch, whereupon the graphical data, which is printed on a web, is sequenced to display subsequent information, such as the information that relates to a subsequent golf hole to be played. An automated indexing arrangement controls the displacement of the web on which the graphical data is printed. The web is installed on a web carrier having associated therewith an alignment arrangement that maintains the web element in predeterminable spatial relation with respect to a predetermined web path and the display region. A gear arrangement is coupled to the web carrier, the gear arrangement having a self-tightening characteristic; The scrolling display arrangement is adapted to draw electrical energy from the vehicle on which it is installed.

16 Claims, 8 Drawing Sheets

AUTOMATED GRAPHICS SCROLLING ARRANGEMENT

RELATIONSHIP TO OTHER APPLICATIOPN

This application claims the benefit of U.S. Provisional Application No. 60/036,993 filed Jan. 30, 1997.

BACKGROUND OF THE INVENTION

1. Field of the Invention

This invention relates generally to arrangements and systems for displaying graphics, and more particularly, to an arrangement for displaying sequentially geographically relevant information, such as information related to the various characteristics of a golf course.

2. Description of the Prior Art

A variety of arrangements are available in the prior art for displaying advertising messages and the like. There is a need, however, for a system that can display information related to specific geographical features, such as on a tour. Conventional message display arrangements do not correlate displayed information in response to geographical location. Accordingly, there is a need for a mobile graphical display arrangement that can be employed to display data relating to predetermined geographical features on a tour, as is often required, for example, when playing a round of golf along a sequence of predetermined golf holes.

SUMMARY OF THE INVENTION

These and other objects are achieved by this invention that provides an arrangement for presenting sequential graphical data that corresponds to predetermined environmental features. In one specific illustrative embodiment of the invention, the information that is sequentially displayed is correlated to the features of a golf course, such as the various characteristics of the respective holes. A player will actuate the arrangement by manipulation of an actuator switch, whereupon the graphical data is sequenced to display sequentially subsequent information, such as the information that relates to a subsequent golf hole to be played.

A first embodiment of this invention provides a scrolling display arrangement having a display region. The scrolling display arrangement includes a web having sequentially arranged information portions thereon and a drive mechanism for moving the web along a predetermined web path making the sequentially arranged information portions of the web viewable in the display region. The scrolling display arrangement also includes an index mechanism coupled to the web for identifying a location of an associated one of the information portions. The scrolling display arrangement further includes a web position signal generator for producing a web position signal in response to the index mechanism and a controller coupled to the drive mechanism for controlling the motion of the web in response to the web position signal.

These and other objects are also achieved by a second embodiment of this invention that provides a scrolling display arrangement having a display region. The scrolling display arrangement includes a web having sequentially arranged information portions thereon and an electrical drive mechanism for moving the web along a predetermined web path by which the sequentially arranged information portions thereof are viewable in the display region. The electrical drive mechanism includes an electrical terminal for receiving electrical energy from a source of electrical energy of a vehicle, the source of electrical energy having a varying voltage characteristic. The scrolling display arrangement also includes an electrical regulator electrically coupled to the electrical drive mechanism for regulating the electrical energy received from the source of electrical energy of the vehicle. The scrolling display arrangement further includes a web carrier coupled to the electrical drive mechanism for supporting the web element as it is moved along the predetermined web path. Associated with the web carrier is an alignment arrangement for maintaining the web in a predeterminable spatial relation with respect to the predetermined web path and the display region. The scrolling display arrangement still further includes a self-tightening gear arrangement coupled to the web carrier and a clutch for rotatably coupling the electrical drive mechanism to the web carrier. The scrolling display arrangement yet further includes an index mechanism coupled to the web element for identifying a location of an associated one of the information portions and a web position signal generator for producing a web position signal in response to the index mechanism. The motion of the web in response to the web position signal is controlled by a controller coupled to the drive mechanism of the scrolling display arrangement.

The foregoing and other objects are also achieved by a third embodiment of this invention that provides a vehicle for operation by an operator. The vehicle including an electrical system having a predeterminable voltage characteristic and an electrical vehicle drive arrangement coupled to the electrical system. The vehicle also including a controller for operating the vehicle along a substantially predetermined path having a plurality of predetermined sequential stations therealong, each such station having a corresponding characteristic distinguishable from that of every other station. The vehicle further including a variable display affixed to the vehicle. The variable display having a display zone viewable by the operator for displaying a sequence of items of information, each item of information corresponding to a respectively associated characteristic associated with the predetermined sequential stations. The items of information are presentable in a presentation sequence corresponding to the sequence of the stations along the substantially predetermined path. The vehicle still further includes a display controller that is operable by the operator for sequencing the items of information displayed in the display zone of the variable display. A timer responsive to the display controller deenergizes the variable display after a predetermined period of time has elapsed following operation of the display controller by the operator; and a reset mechanism bypasses the display controller whereby the variable display is actuated to display in the display zone a predetermined initial item of information.

In a further specific illustrative embodiment of the invention, the scrolling graphical display is installed on a vehicle, such as a golf cart. Electrical energy for effecting the actuation is drawn from the electrical system of the vehicle.

BRIEF DESCRIPTION OF THE DRAWING

Comprehension of the invention is facilitated by reading the following detailed description, in conjunction the annexed drawing, in which.

DETAILED DESCRIPTION

Figure 1:
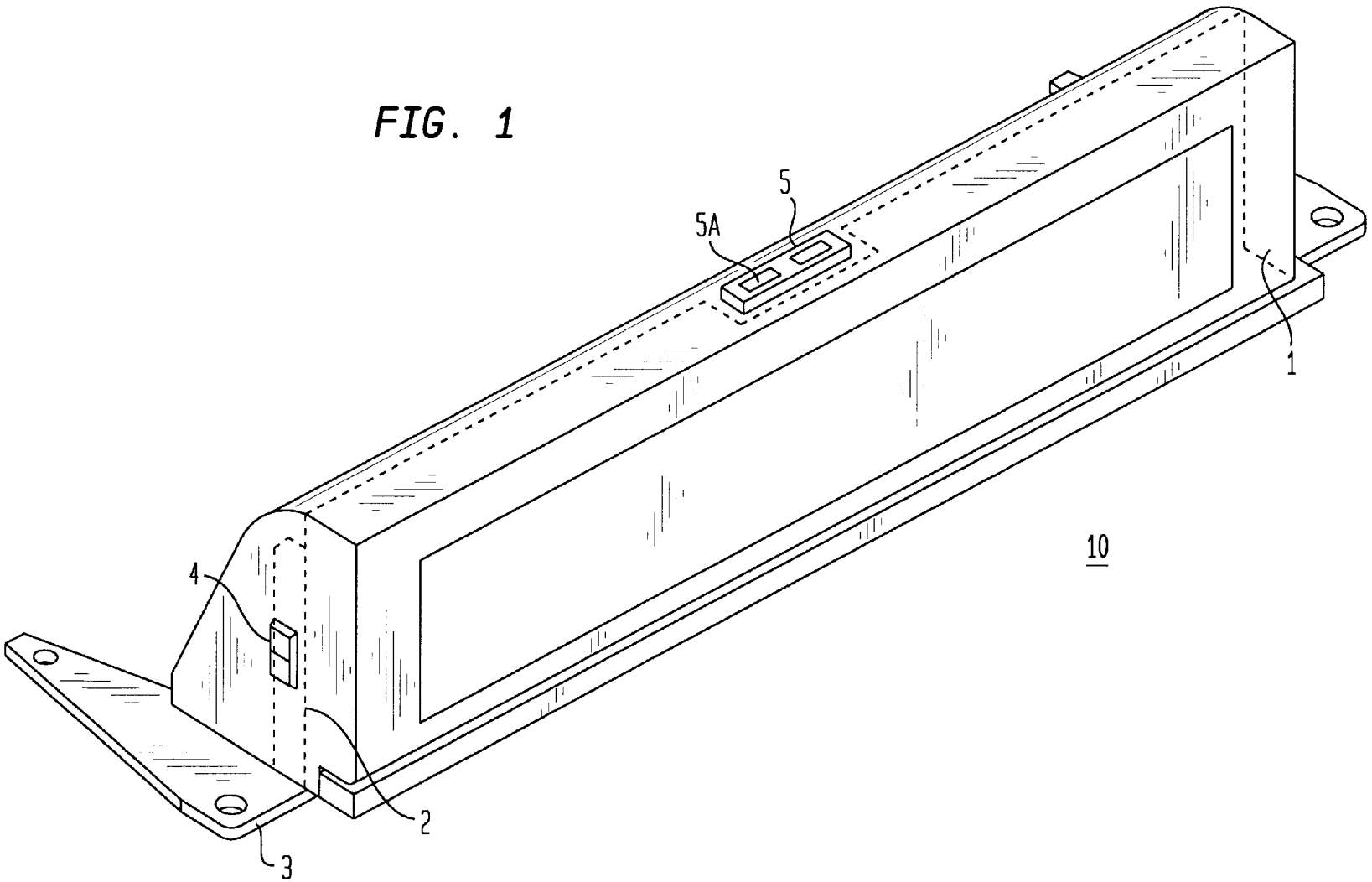
FIG. 1 is an isometric representation of a display arrangement constructed in accordance with the invention.

FIG. 1 is a schematic representation of a specific illustrative embodiment of a scrolling display arrangement 10. As shown, scrolling display arrangement 10 has a face portion 1, a side portion 2 having a flange 3 with apertures therethrough for facilitating installation, such as on a golf cart (not shown in this figure). On side portion 2 there is provided a reset switch 4 which, as will be described hereinbelow, is used to reset the web (not shown in this figure) to a start position. Also as will be described hereinbelow, the display is sequenced by actuation of switches 5 arranged on the top of the scrolling display arrangement.

Figure 2C:
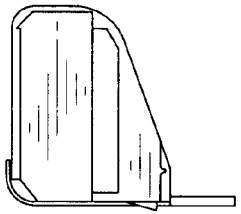
FIG. 2C is a side plan view of the display arrangement of FIG. 1.
Figure 2A:
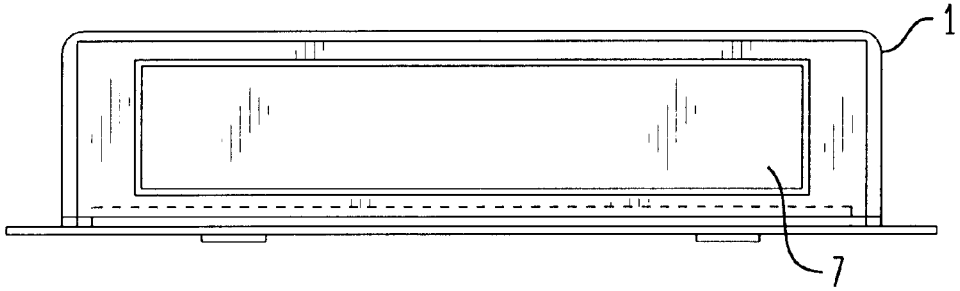
FIG. 2A is a front plan view of the display arrangement of FIG. 1.

FIG. 2A is a front plan representation of the embodiment of FIG. 1 and indicates the arrangement to have an overall width of 32 inches, in this specific illustrative embodiment of the invention. A display panel 7 is dimensioned to have a width of 27.5 inches and a height of 5.5 inches.

Figure 2B:
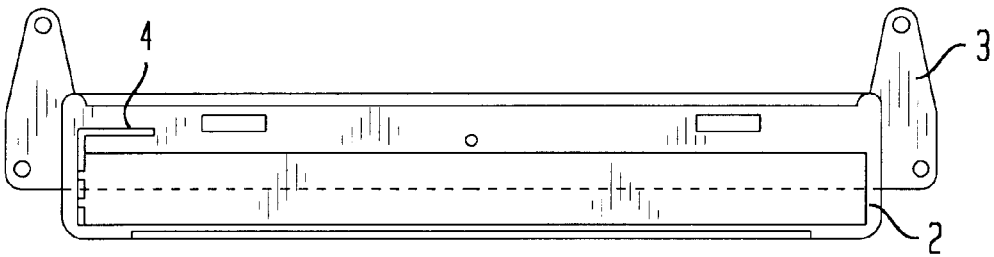
FIG. 2B is a top plan view of the display arrangement of FIG. 1.

FIG. 2B is a top plan view of the embodiment of FIG. 1, and shows, in this specific illustrative embodiment of the invention, that flange portions 3 are approximately 7.125 inches in length, whereby they are adaptable to install the scrolling display on a golf cart (not shown).

FIG. 2C is a side plan view of the embodiment of FIG. 1, and shows an overall depth dimension of the scrolling display arrangement exclusive of flanges 3, to be approximately 6.0625 inches, in this embodiment. All of the dimensions shown in the figures and described herein are illustrative only. Persons of skill in the art can configure embodiments of the invention, in light of the teaching herein, of different dimensions.

Figure 3:
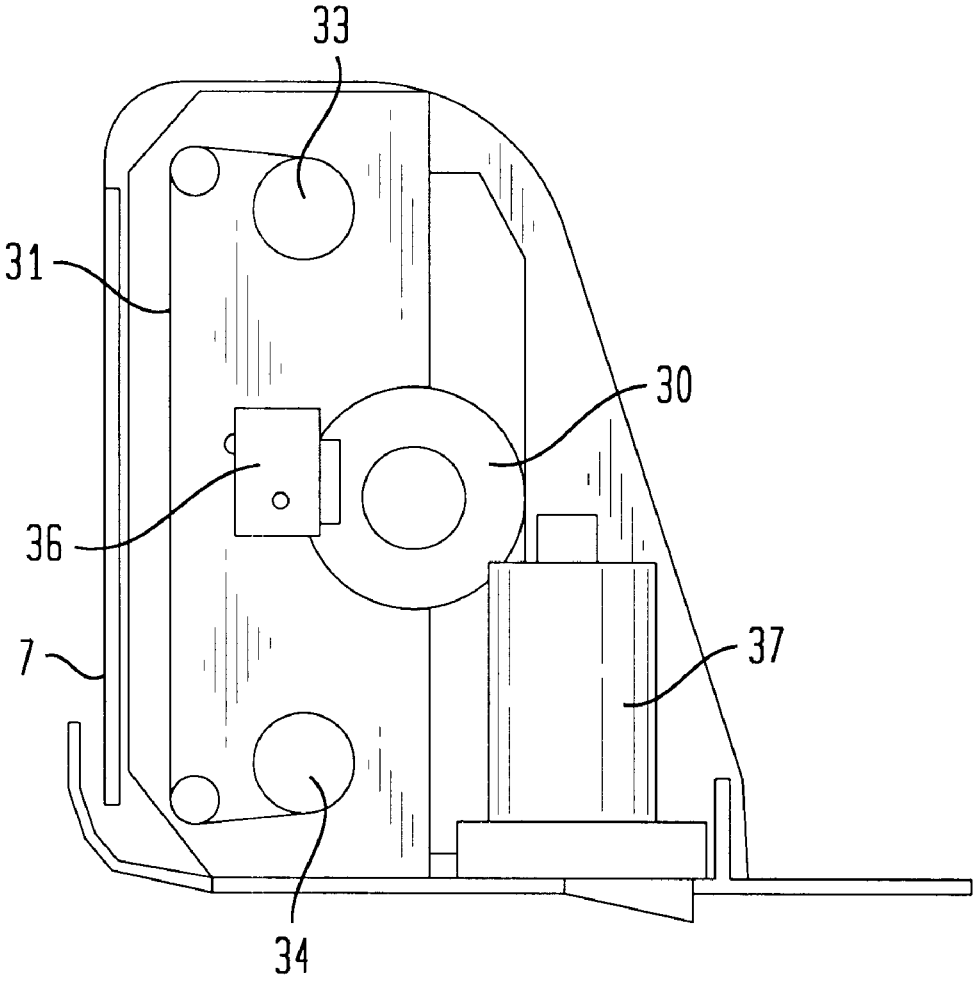
FIG. 3 is a cross-sectional side view of the display arrangement of FIG. 1, showing certain mechanical features.

FIG. 3 is a partially cross-sectional representation of the embodiment of FIG. 1, showing certain mechanical features of the arrangement. As shown, there is provided a motor 30 which is arranged to drive a web 31. In this specific illustrative embodiment of the invention, the web is formed as a polygloss curtain that is wound about a curtain roller tube 33. Upon actuation of switch 5 (FIG. 1), the motor is actuated and the web is rolled onto a take-up roller 34. As will be described below, the travel of web 31 across display panel 7 is indexed by operation of a retroreflective dual photo switch 36. Also in this embodiment, a timer 37 is employed to provide a time-out feature, which in this embodiment may be programmable.

Figure 4:
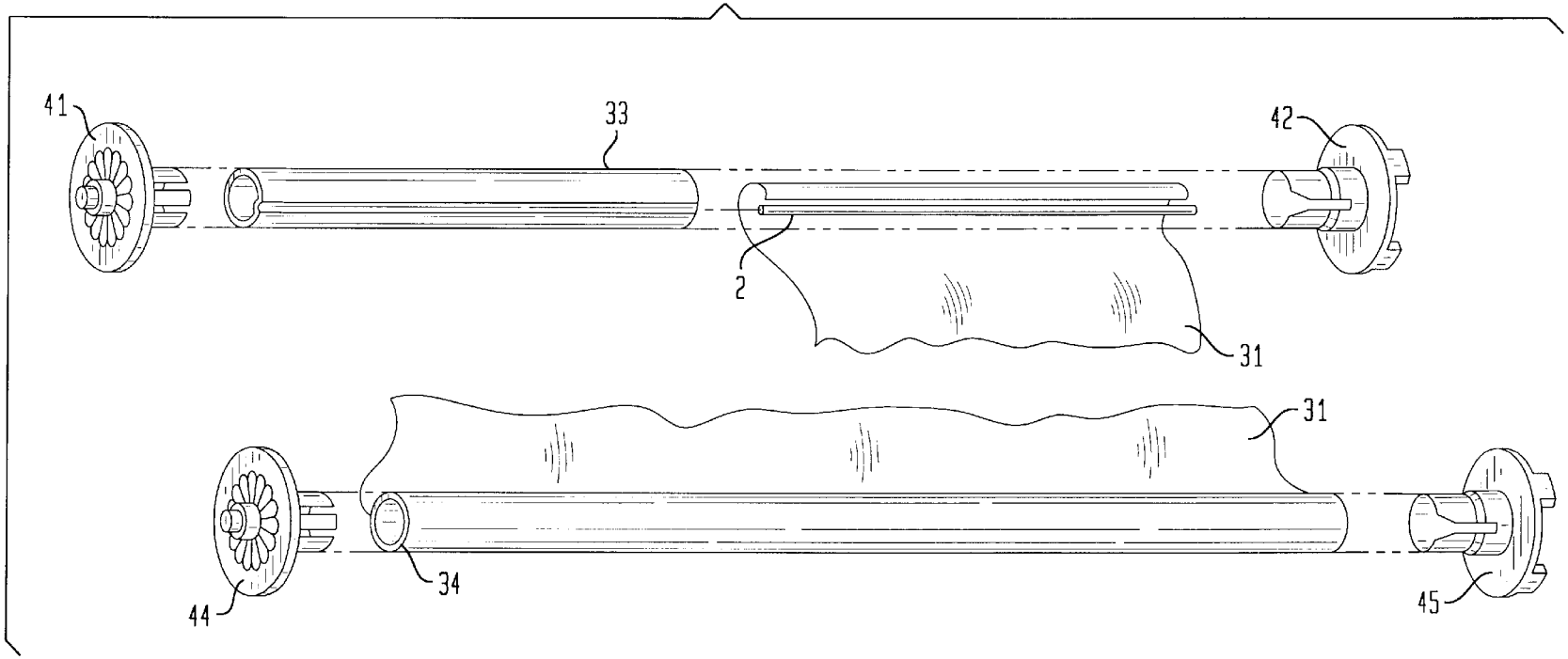
FIG. 4 is an isometric representation of a web arrangement showing a pair of rollers employed therewith.

FIG. 4 is a schematic representation of web 31 shown in relation to curtain roller tube 33 and take-up roller 34. Each of the rollers is provided with a termination at each end thereof, such as terminations, 41 and 42, associated with curtain roller tube 33, and terminations 44 and 45 associated with take-up roller 34.

Figure 5:
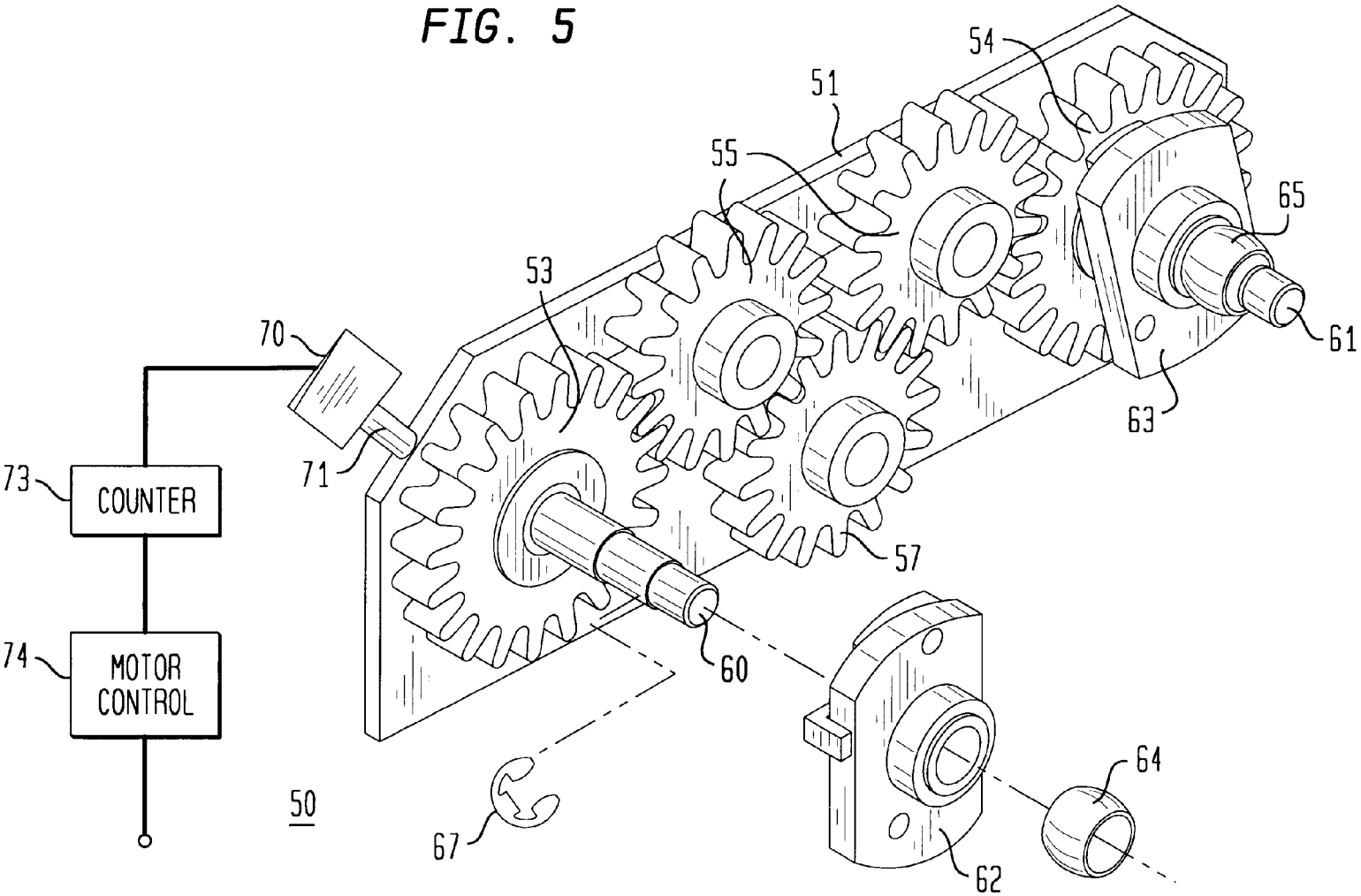
FIG. 5 is a gear train arrangement illustrating an automatic arrangement for taking up slack in the web.

FIG. 5 is a schematic representation of a gear drive arrangement 50 that is adapted to take-up the slack automatically from web 31 (not shown in this figure). As shown, the gear drive arrangement in this specific illustrative embodiment of the invention is installed on a plate 51 and includes drive gears 53 and 54 that are coupled via respectively associated ones of idler gears 55 to a driven gear 57. Driven gear 57 is coupled to a motor (not shown) that supplies the torque necessary to rotate the drive gears and rollers 33 and 34 (not shown in this figure) coupled thereto.

Each of the drive gears is installed on an associated one of shafts 60 and 61. Additionally, there is installed on each of the shafts a respective one of pawls 62 and 63 and a respective one bearings 64 and 65. The drive gears, pawls, and bearings are secured to the shafts by respective ones of retaining rings 67. The pawls serve to control the direction of rotation of the drive gears, to reduce the likelihood of slackening of the web.

In addition to the foregoing, there is schematically illustrated in this specific illustrative embodiment of the invention an inductive pick-up 70 having a probe portion 71 that is arranged in the vicinity of drive gear 53. In this embodiment, drive gear 53 is made of a metallic material and causes a pulsed output electrical signal to be produced at the output terminal (not specifically designated) of the inductive pick-up. The pulses in the output signal correspond to the passage of the gear teeth of drive gear 53 near probe portion 71, and are counted in a counter 73. Counter 73 controls the operation of the drive motor (not shown) via a motor control arrangement 74. Illustratively, the motor is caused to be operated until a predetermined number (e.g., 21) gear teeth have been counted. In one embodiment, the motor and the counter are started in response to the actuation of switch 5, as will be described below. The predetermined number of the gear teeth to be counted corresponds to the displacement of the web desired to achieve a transition between sequential ones of the graphical scenes displayed on the web, as will be discussed below.

Figure 6:
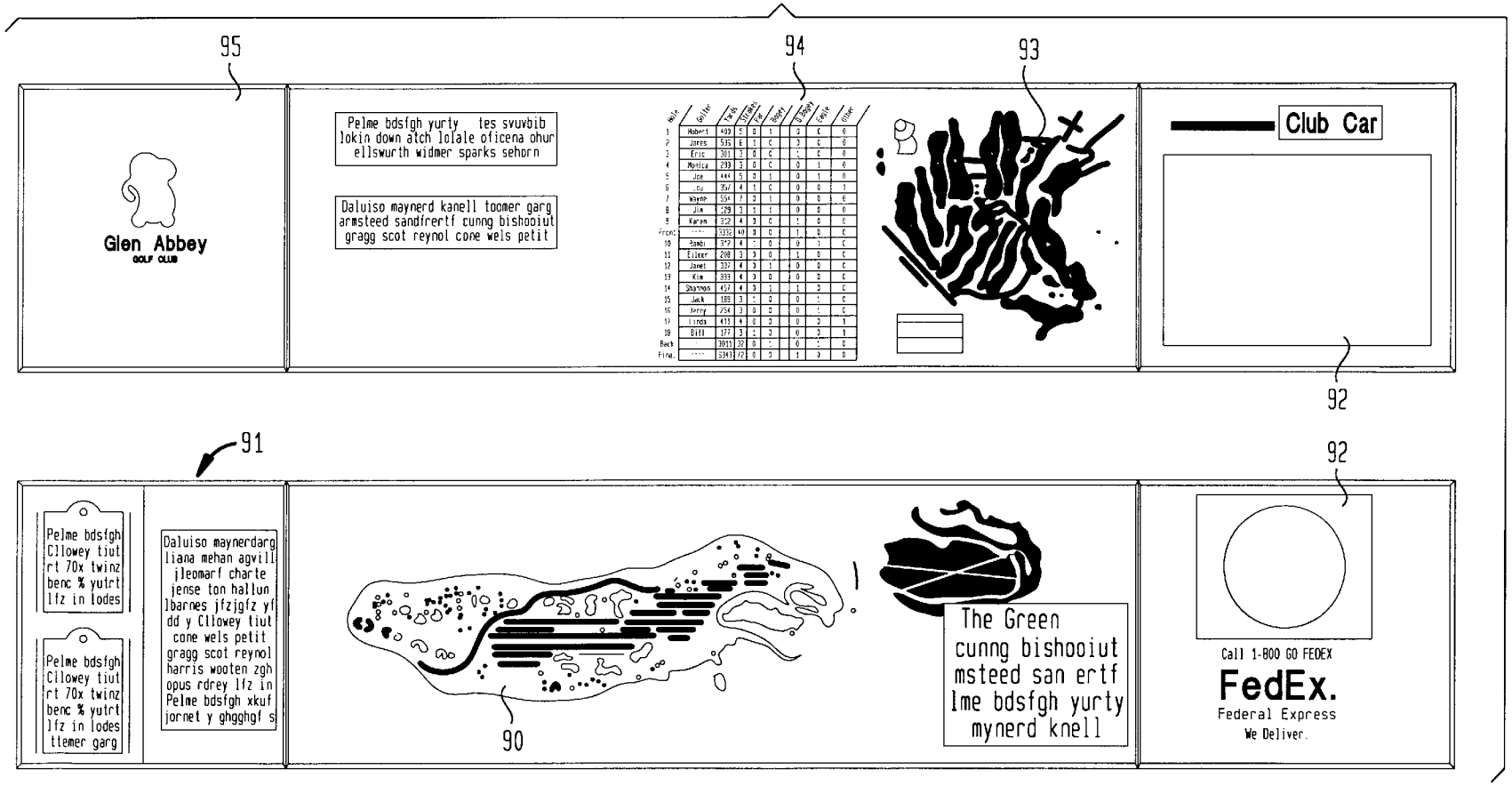
FIG. 6 is a plan representation of certain illustrative displays in a golfing embodiment of the invention.

FIG. 6 is a plan representation of illustrative displays related to geographical features of a golf course, specifically golf holes. As shown, each display includes geographical information, in the form of a map 90 of the hole, and text data 91 related thereto. In this specific illustrative embodiment of the invention, there is additionally provided an advertisement portion. 92, as well as overall course data 93 and scoring information 94. The logo or mark of the particular golf club is included in region 95.

Figure 7:
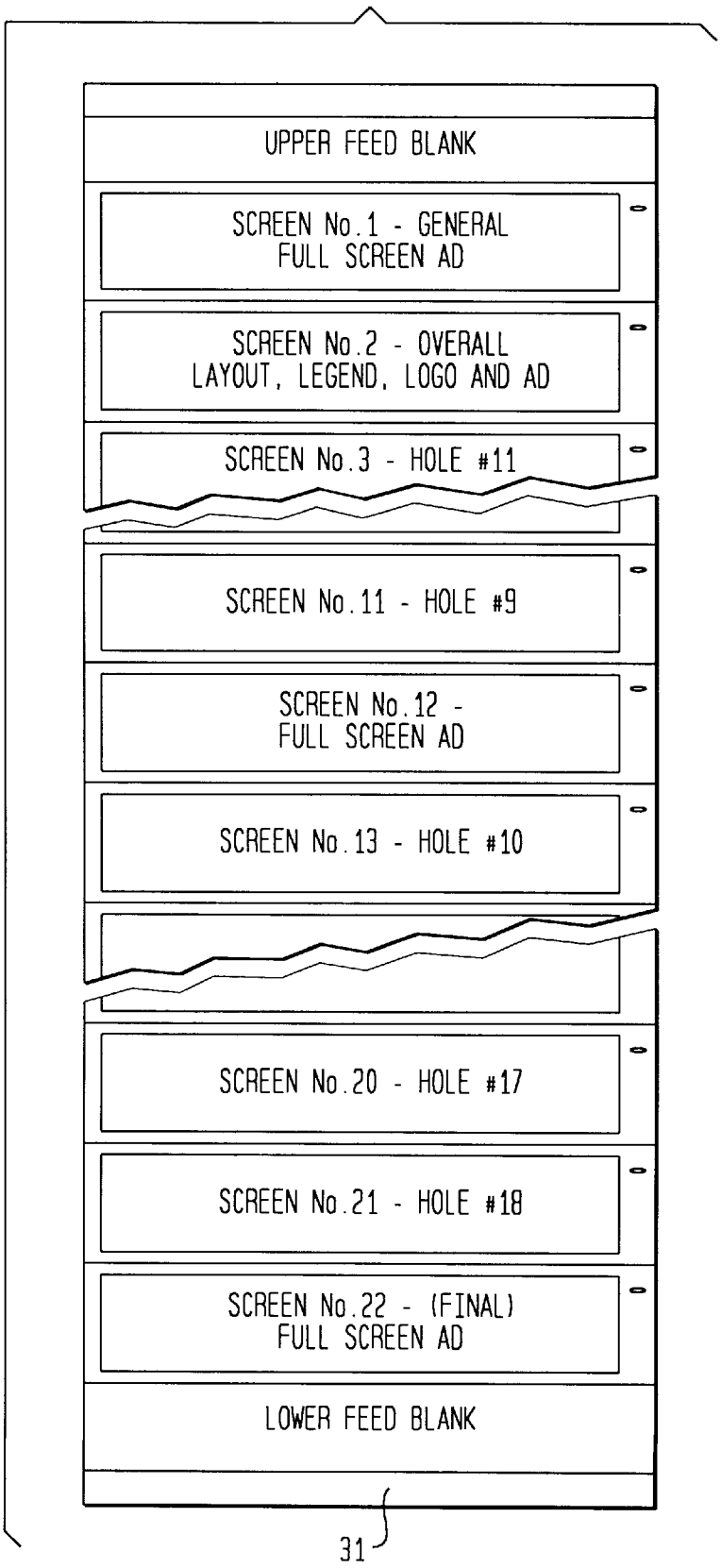
FIG. 7 is a schematic plan representation of the relationship between a variety of sequential display screens on the web of the arrangement of FIG. 1.

FIG. 7 is schematic plan representation of web 31 illustrated in extended form whereby is shown the relationship between the sequential display screens thereon. In this embodiment, the forward direction is upward, i.e., from roller 34 to roller tube 33 in FIG. 3. In operation, each such screen in FIG. 7 in this specific illustrative embodiment of the invention has an associated indexing feature, which may be in the form of a hole or retroreflective portion (not shown). The retroreflective portion may be arranged on the reverse side of the web from that shown in this figure, whereby it can interact optically with a photoelectric device, such as photoswitch 36 of FIG. 3. The indexing feature of FIG. may be employed as an alternative control arrangement to the inductive probe and electronic counter system described above with respect to FIG. 5.

Figure 8:
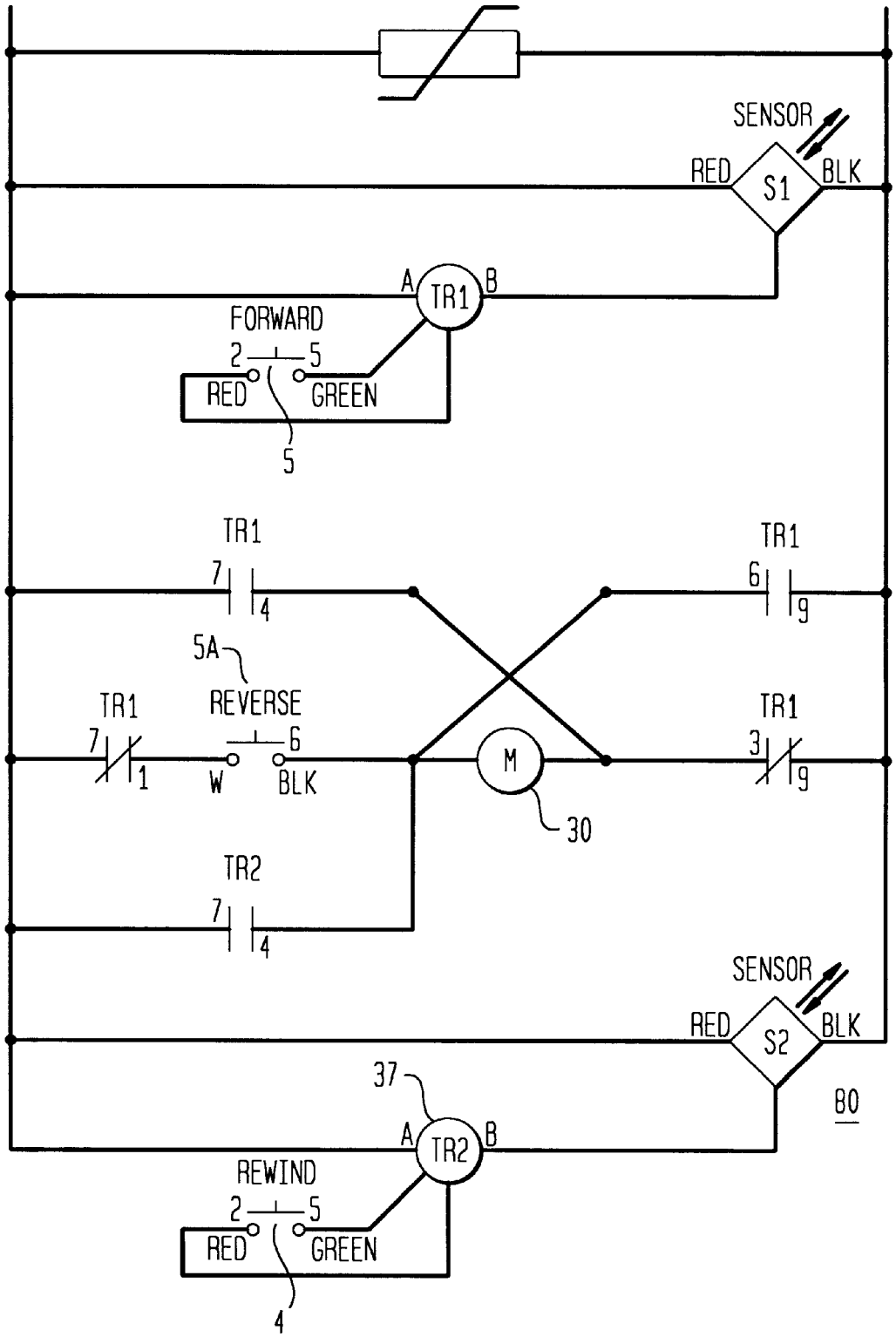
FIG. 8 is a schematic of the power drive arrangement.

FIG. 8 is a schematic representation of a power drive circuit 80 useful to actuate motor 37 into a selected one of a plurality of operating modalities. More specifically, switch 5 effects forward operation of the motor. Switch 5A effects reversal of the motor. A rewind operation is initiated upon actuation of switch 4 which, as shown, initiates operation of timer relay 37.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A scrolling display arrangement having a display region comprising:

a web element having a plurality of sequentially arranged information portions thereon;

a drive arrangement for moving said web element along a predetermined web path whereby the sequentially arranged information portions thereof are viewable in the display region;

an indexer coupled to the web element for identifying a location of an associated one of the information portions;

a web position signal generator for producing a web position signal in response to said indexer;

a web carrier coupled to said drive arrangement for supporting said web element as it is moved along the predetermined web path;

an alignment arrangement coupled to said web carrier for maintaining said web element in a predeterminable spatial relation with respect to the predetermined web path and the display region;

a gear arrangement having a self-tightening characteristic coupled to said alignment arrangement; and a controller coupled to said drive arrangement for controlling the motion of said web element in response to the web position signal.

2. The scrolling display arrangement of claim 1, wherein said drive arrangement moves said web element in first and second directions along the predetermined web path, the motion in the first direction being responsive to the web position signal.

3. The scrolling display arrangement of claim 2, wherein said web element has a predetermined web length and there is further provided a fail safe arrangement for preventing excessive effort on the part of said drive arrangement toward moving said web element beyond said predetermined web length.

4. The scrolling display arrangement of claim 3, wherein said fail safe arrangement comprises a fail safe deenergization arrangement for discontinuing an effort by said drive arrangement to move said web element.

5. The scrolling display arrangement of claim 4, wherein said fail safe deenergization arrangement comprises a programmable timer for discontinuing the effort by said drive arrangement to move said web element after a predetermined period of time.

6. The scrolling display arrangement of claim 1, wherein there is further provided a second controller, and said drive arrangement moves said web element in the second direction along the predetermined web path in response to said second control arrangement.

7. The scrolling display arrangement of claim 6, wherein said second control arrangement comprises electrical latch means for controlling said drive arrangement to move said web element to a predetermined first information portion.

8. The scrolling display arrangement of claim 1, wherein said indexer comprises a position indicator arranged in predetermined relation with respect to said web element for defining a location of said web element having a predetermined relationship to the associated one of the information portions.

9. The scrolling display arrangement of claim 8, wherein said web position signal generator comprises a sensor having an electrical output for producing the web position signal in response to a predetermined spatial relationship between said position indicator and said sensor.

10. The scrolling display arrangement of claim 1, wherein said drive arrangement comprises an electrical drive, said electrical drive having an electrical terminal for receiving electrical energy from a source of electrical energy, there being further provided an electrical regulator electrically coupled to said electrical terminal for regulating the electrical energy received from said source of electrical energy.

11. The scrolling display arrangement of claim 10, wherein the source of electrical energy is an electrical system of a vehicle, the source of electrical energy having a varying voltage characteristic.

12. The scrolling display arrangement of claim 10, wherein there is further provided clutch means for mechanically coupling said electrical drive to said web carrier.

13. A scrolling display arrangement having a display region comprising:

a web element having a plurality of sequentially arranged information portions thereon;

electrical drive means for moving said web element along a predetermined web path whereby the sequentially arranged information portions thereof are viewable in the display region, said electrical drive means having an electrical terminal for receiving electrical energy from a source of electrical energy of a vehicle, the source of electrical energy having a varying voltage characteristic;

electrical regulator means electrically coupled to said electrical drive means for regulating the electrical energy received from the source of electrical energy of the vehicle;

web carrier means coupled to said electrical drive means for supporting said web element as it is moved along the predetermined web path, said web carrier means having associated therewith an alignment arrangement for maintaining said web element in a predeterminable spatial relation with respect to the predetermined web path and the display region;

a gear arrangement coupled to said web carrier means, said gear arrangement having a self-tightening characteristic;

a clutch for rotatably coupling said electrical drive means to said web carrier means;

index means coupled to the web element for identifying a location of an associated one of the information portions;

web position signal generating means for producing a web position signal in response to said index means; and control means coupled to said drive means for controlling the motion of said web element in response to the web position signal.

14. The scrolling display arrangement of claim 13, wherein said drive means is arranged to move said web element in first and second directions along the predetermined web path, the motion in the first direction being responsive to the web position signal, and there is further provided:

a programmable timer for deenergizing said drive means whereby motion of said web element in the first direction after a predetermined period of time; and rewind means for bypassing said control means whereby said drive means is actuated to move said web element in the second directions along the predetermined web path notwithstanding said web position signal.

15. The scrolling display arrangement of claim 13, wherein the vehicle is an electrically powered vehicle of the type having an electrical system, the electrical energy supplied from the electrical system to said electrical regulator means having a voltage characteristic that varies with the operational state of the electrically powered vehicle.

16. The scrolling display arrangement of claim 15, wherein the electrically powered vehicle is a golf cart, and there is further provided mounting means for affixing said web carrier means to the golf cart.

* * * * *